US007097589B2

(12) United States Patent
Underwood et al.

(10) Patent No.: US 7,097,589 B2
(45) Date of Patent: Aug. 29, 2006

(54) SAFETY JUMP TRAINING APPARATUS

(75) Inventors: Bradford J Underwood, Columbus, OH (US); David K Dunlap, deceased, late of Columbus, OH (US); by Cyndie M. Dunlap, legal representative, Columbus, OH (US)

(73) Assignee: Sports Imports, Inc., Hilliard, OH (US)

( * ) Notice: Subject to any disclaimer, the term of this patent is extended or adjusted under 35 U.S.C. 154(b) by 393 days.

(21) Appl. No.: 10/793,148

(22) Filed: Mar. 4, 2004

(65) Prior Publication Data

US 2005/0202935 A1 Sep. 15, 2005

(51) Int. Cl.
*A63B 5/16* (2006.01)
*A63B 69/00* (2006.01)

(52) U.S. Cl. ..... 482/15; 473/447

(58) Field of Classification Search ..... 482/14–15, 482/909, 83–90; 273/127 R, 127 D; 473/447, 473/476–477

See application file for complete search history.

(56) References Cited

U.S. PATENT DOCUMENTS 2,469,145 A * 5/1949 Baliff ..... 482/148
2,697,603 A 12/1954 Haines
3,012,781 A * 12/1961 Nelson ..... 473/430
3,258,266 A * 6/1966 Kamish ..... 73/432.1
3,534,956 A * 10/1970 Myers ..... 482/148
3,690,664 A * 9/1972 Hauke et al. ..... 273/127 D
3,795,396 A 3/1974 Kropelnitski
4,208,050 A * 6/1980 Perrine et al. ..... 482/148
4,344,628 A * 8/1982 Warehime ..... 473/476
5,031,903 A * 7/1991 Clarke ..... 482/148
5,072,931 A * 12/1991 Carlson ..... 482/15
5,209,713 A * 5/1993 Brown et al. ..... 482/92
5,498,221 A * 3/1996 Blair, Jr. ..... 482/99
6,416,447 B1 * 7/2002 Harmon ..... 482/129

* cited by examiner

*Primary Examiner*—Jerome Donnelly
*Assistant Examiner*—Fenn C. Mathew
(74) *Attorney, Agent, or Firm*—Gallagher & Dawsey Co., LPA; Michael J. Gallagher; David J. Dawsey

(57) ABSTRACT

A safety jump training apparatus designed for safely mounting on a wall to permit an athlete to safely measure their vertical leap. The safety jump training apparatus includes a jump measurement device and a rotating support to rotably attach the measurement device to a mounting plate, as well as numerous safety features. The safety features include cooperating locking pin recesses and a locking pin to secure the apparatus in either an operating position or a storage position, a lock to adjustably secure the vertical height of the measurement device, a translation resistor to control the movement of the measurement device when the lock is disengaged, a safety position limiter to ensure that the measurement device is always a predetermined distance above the ground, and a safety cover to safely contain majority of the apparatus.

23 Claims, 5 Drawing Sheets

SAFETY JUMP TRAINING APPARATUS

TECHNICAL FIELD

The present invention relates to the field of jump training devices, in particular, to a safety jump training device for safely measuring an athlete's vertical leap when in an operating position and having a storage position wherein the device is safely and compactly stored against a wall.

BACKGROUND OF THE INVENTION

In the past quarter-century athletes and coaches have come to realize that the vertical leap of an athlete is a good indicator of success in a wide variety of sports. As such, today an athlete's vertical leap is used to measure an athlete's capabilities in much the same way the 40 yard dash is used. With this recognition of the importance of the vertical leap, athletes now train to improve their vertical leap. Accordingly, devices that safely and accurately measure an athlete's vertical leap are in demand.

Prior art jump trainers have failed to incorporate adequate safety features to minimize the risk of an athlete being injured while measuring vertical leap. A common problem with early jump trainers, such as the one of U.S. Pat. No. 4,208,050 was that they were prone to tip over and cause injury to the athlete or coach. To alleviate this problem manufacturers focused on improving the base of the unit that rests on the floor.

One common solution was to add the capability of adding weights in the form of barbell plates to the base. While attempting to solve one problem, another was created. Since jump trainers are commonly located in weight rooms, athletes often remove weights from the base for use on other machines. Such removal again revealed the natural tendency of the jump trainer to tip over. Additionally, the barbell plates are often left scattered around the area of the trainer creating potential hazards for the users. After all, if an athlete measuring their vertical leap lands with a portion of a foot on a plate, even if the plate is only one-quarter to one-half inch thick, the athlete often ends up with a severely sprained, or broken, ankle. Still further, the base units outfitted to accept barbell plates generally include a six to eight inch steel post extending vertically from the corners of the base unit to accept the barbell plates. These steel posts create a potentially life threatening hazard to an athlete that has lost their balance and is falling in the vicinity of the posts.

Yet another problem with conventional jump trainers is that they consume a great deal of floor space and are not easily stored. It is common to see jump trainers scattered about a gymnasium during volleyball or basketball practice. Such jump trainers are a dangerous hazard to a player chasing a ball out of bounds.

Wall-mounted jump trainers have alleviated some of the previously mentioned safety hazards, but not all. For instance, the wall-mounted jump trainer of U.S. Pat. No. 5,031,903 addresses the safety issues surrounding the base of floor mounted units, but presents other safety issues and drawbacks. For instance, the '903 device is a fixed jump trainer that is not vertically adjustable and is permanently affixed to the wall. Rigidly attached jump trainers that extend orthogonally from the wall pose just as great a danger, if not greater, to athletes than ground mounted units. In such installations the bottom of the jump trainer is at the head height of many athletes and creates an even greater danger than the floor mounted units, because it is rigidly attached to the wall. Therefore, one can imagine that if such wall-mounted trainers were located around the perimeter of a gymnasium, an athlete chasing a loose ball could accidentally strike the device and knock themselves unconscious.

Accordingly, the art has needed a wall-mounted jump training apparatus that is easy to use, safe, and can be conveniently stored away when not in use.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. The instant invention demonstrates such capabilities and overcomes many of the shortcomings of prior methods in new and novel ways.

The safety jump training apparatus of the present invention is one designed for safely mounting on a wall and permits an athlete to safely measure their vertical leap. The apparatus has two positions; an operating position and a storage position. When the apparatus is in the operating position it is substantially orthogonal to the mounting wall and provides the athlete exceptional access to the apparatus. Conversely, the apparatus is substantially parallel to the wall when in the storage position, thereby removing the apparatus from areas subject to walking traffic, or other athletic events, and minimizing the risk of inadvertent contact.

The safety jump training apparatus includes a jump measurement device and a rotating support to attach the measurement device to a mounting plate, as well as numerous safety features. Briefly, the safety features include cooperating locking pin recesses and a locking pin to secure the apparatus in either the operating position or the storage position, a lock to adjustably secure the vertical height of the measurement device, a translation resistor to control the movement of the measurement device when the lock is disengaged, a safety position limiter to ensure that the measurement device is always a predetermined distance above the ground, and a safety cover to safely contain majority of the apparatus.

The jump measurement device of the present invention is that portion consisting of a plurality of vanes rotably mounted to a vane mounting post that is joined to a vertical post having a safety position limiter. In use, an athlete jumps vertically and slaps the vanes so that they rotate about the mounting post, thereby providing an indication of the maximum height that the athlete achieved. A vane stop may be incorporated to stop the vanes at a predetermined location. The vane stop provides a positive stop ensuring an athlete's hand and arm are not injured by a rapidly rotating vane.

The rotating support has at least one arm and a vertical sleeve attached to the at least one arm. The vertical sleeve is shaped to cooperate with the shape of the vertical post so that the vertical post is slidably received by the sleeve, thereby allowing adjustment of the height of the jump measuring device. The motion of the vertical post in the sleeve is limited by the safety position limiter such that the end of the vertical post is limited to a predetermined dimension above a floor surface to ensure that the end does not injure a foot of the athlete during adjustment of the post.

The lock is attached to the sleeve and serves to provide the adjustability of the height of the jump measurement device. The lock has an engaged position, wherein the vertical post is secured within the sleeve, and a disengaged position, wherein the vertical post is not secured by the lock. The automatic translation resistor is yet another safety improvement designed to minimize the risk of an athlete either getting their finger pinched in the apparatus or their foot injured by an uncontrolled post. The automatic translation resistor is attached to the sleeve and continuously applies a compressive force on the vertical post to counteract the gravitational force on the jump measurement device and prevent it from accidental translation within the sleeve when the lock is disengaged. The automatic translation resistor requires the athlete to disengage the lock and intentionally apply force to the vertical post in order to adjust the height of the jump measurement device.

The at least one rotational mount is attached to the mounting plate and is designed to releasably and rotationally attach the arm to the mounting plate. The at least one rotational mount permits the rotating support and the jump measurement device to rotate from the operating position to the storage position where the rotating support and jump measurement device are substantially parallel to the wall. The at least one rotational mount includes a guide plate having a plate guide pin recess that aligns with an arm guide pin recess formed in the arm such that a guide pin is received by the plate guide pin recess and the arm guide pin recess thereby releasably and rotably joining the guide plate and the at least one arm. The guide plate may include at least one auxiliary recess arranged such that a padlock may be secured through the auxiliary recess thereby preventing unauthorized users from rotating the jump measuring device from the storage position to the operating position.

In yet another embodiment, the apparatus includes a safety cover that encloses majority of the apparatus when it is in the storage position to prevent unintentional contact with such components. The safety cover may further be padded to absorb the impact of a colliding athlete. These variations, modifications, alternatives, and alterations of the various preferred embodiments may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

DETAILED DESCRIPTION OF THE INVENTION

The safety jump training apparatus of the instant invention enables a significant advance in the state of the art. The preferred embodiments of the apparatus accomplish this by new and novel arrangements of elements and methods that are configured in unique and novel ways and which demonstrate previously unavailable but preferred and desirable capabilities.

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 1:
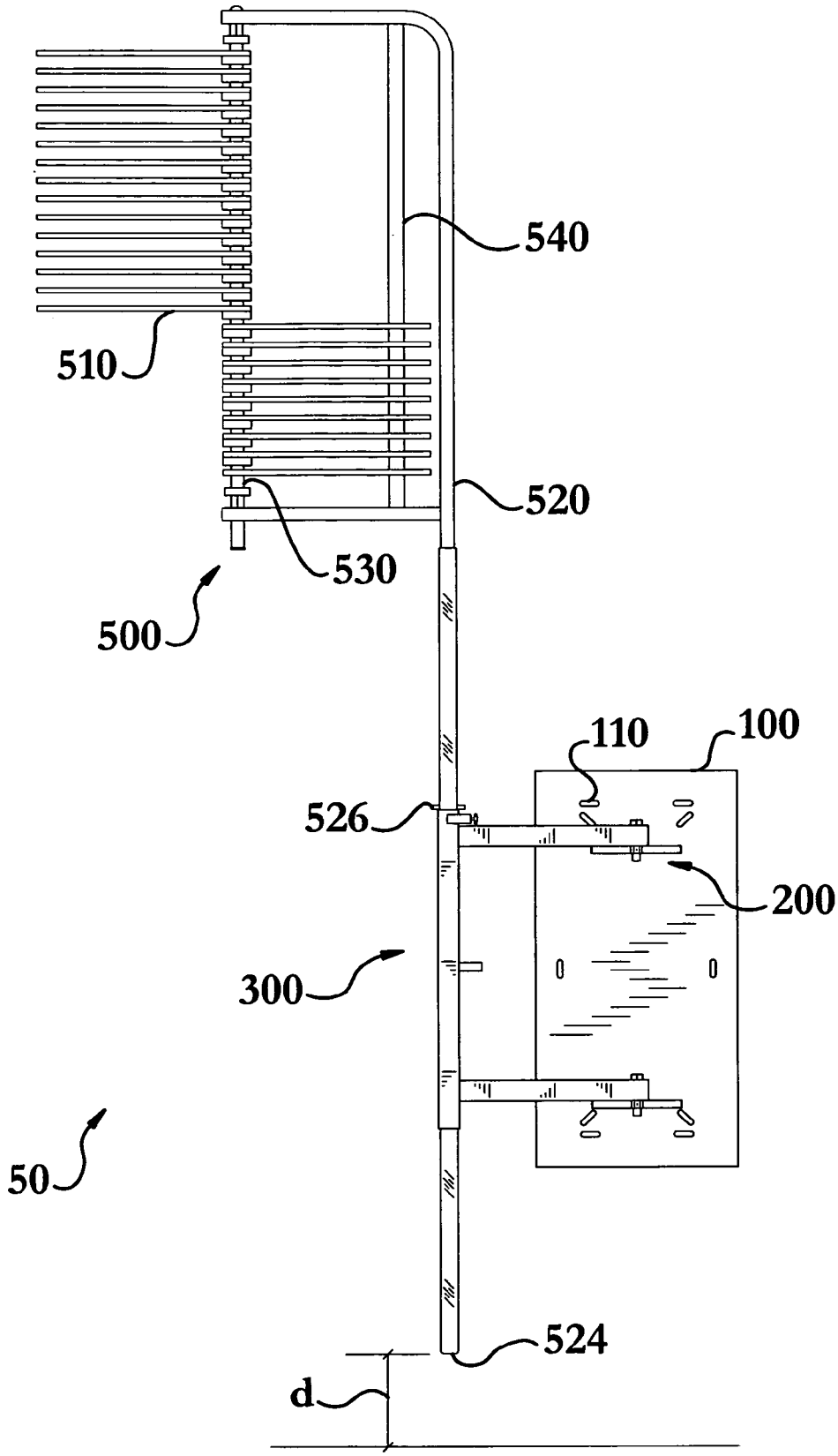
FIG. 1 shows an elevation view of the apparatus in the storage position, not to scale.

Referring to FIG. 1, the safety jump training apparatus 50 of the present invention is one designed for safely mounting on a wall and permits an athlete to safely measure their vertical leap. The apparatus 50 has two positions; an operating position and a storage position. When the apparatus 50 is in the operating position it is substantially orthogonal to the mounting wall and provides the athlete exceptional access to the apparatus 50 while also minimizing the risk of loose weights being placed in the vicinity of the apparatus 50 that may cause injury to the athlete, as is common with floor-mounted units. The apparatus 50 is substantially parallel to the wall when in the storage position thereby removing the apparatus 50 from areas subject to walking traffic, or other athletic events, and minimizing the risk of inadvertent contact.

The safety jump training apparatus 50 includes a jump measurement device 500 and a rotating support 300 to attach the measurement device 500 to a mounting plate 100, as well as numerous safety features. Briefly, the safety features seen in FIG. 2 and FIG. 3 include cooperating locking pin recesses 214 and a locking pin 318 to secure the apparatus 50 in either the operating position or the storage position, a lock 322 to adjustably secure the vertical height of the measurement device 500, a translation resistor 326 to control the movement of the measurement device 500 when the lock 322 is disengaged, a safety position limiter 526 to ensure that the measurement device 500 is always a predetermined distance d above the ground, and a safety cover 600, illustrated in FIG. 10 and FIG. 11, to safely contain a majority of the apparatus 50.

The jump measurement device 500 of the present invention is that portion consisting of a plurality of vanes 510 rotably mounted to a vane mounting post 530 that is joined to a vertical post 520 having a safety position limiter 526. In use, an athlete jumps vertically and slaps the vanes 510 so that they rotate about the mounting post 530, thereby providing an indication of the maximum height that the athlete achieved. The vanes 510 are installed such that they are under compression, thereby providing some resistance to rotation and reducing the likelihood that the vanes 510 ever rotate a full revolution. However, to ensure that over time the vanes 510 do not become loose and freely rotate, a vane stop 540 may be incorporated to stop the vanes 510 at a predetermined location. The vane stop 540 provides a positive stop ensuring an athlete's hand and arm are not injured by a rapidly rotating vane 510.

Figure 2:
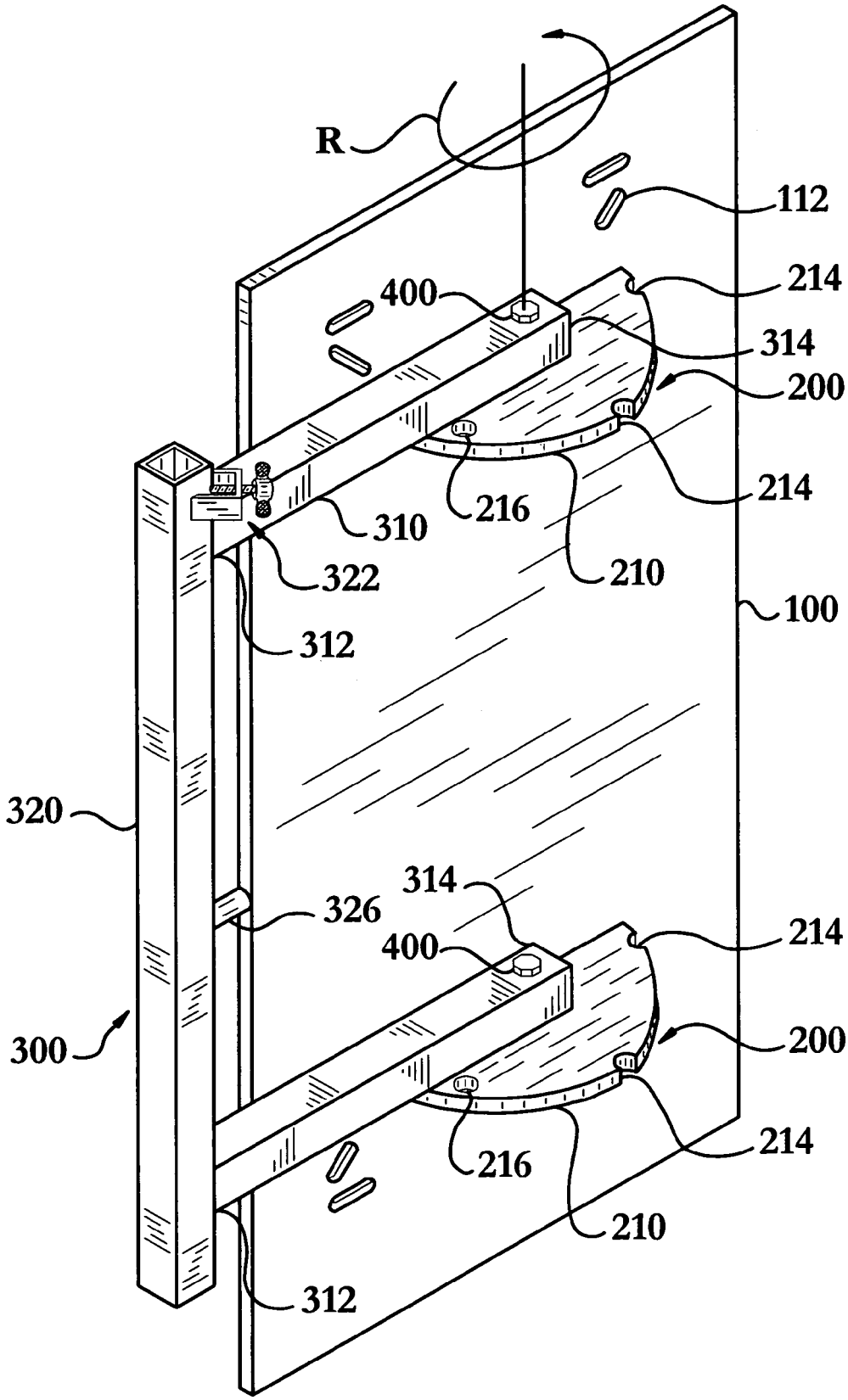
FIG. 2 shows an elevated isometric view of a portion of the apparatus, not to scale.

With reference now to FIG. 2, the rotating support 300 has at least one arm 310, with a distal end 312 and a proximal end 314, and a vertical sleeve 320 attached to the distal end 312 of the at least one arm 310. The embodiments illustrated in FIG. 1 through FIG. 11 have two arms 310, however one with skill in the art will recognize that the apparatus 50 may utilize a single arm 310, or more than two arms 310. The vertical sleeve 320 is shaped to cooperate with the shape of the vertical post 520 so that the vertical post 520 is slidably received by the sleeve 320, thereby allowing adjustment of the height of the jump measuring device 500, as seen in FIG. 1. The illustrative embodiments of FIG. 1 through FIG. 11 show rectangular tubular components for the sleeve 320 and the vertical post 520, however the sleeve 320 and the post 520 may be of virtually any cross-sectional geometry.

Figure 7:
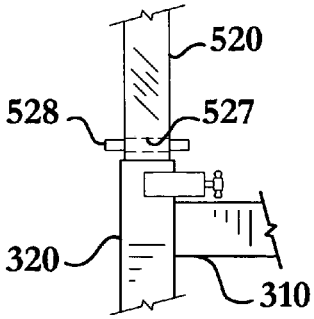
FIG. 7 shows a partial side elevation view of an embodiment of the vertical post, sleeve, and arm, not to scale.
Figure 8:
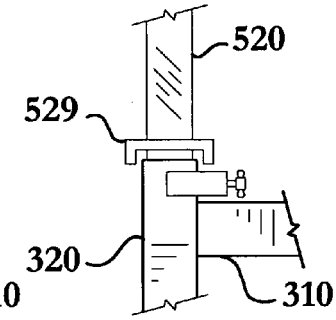
FIG. 8 shows a partial side elevation view of an embodiment of the vertical post, sleeve, and arm, not to scale.

The motion of the vertical post 520 in the sleeve 320 is limited by the safety position limiter 526 such that a proximal end 524 of the vertical post 520 is limited to a predetermined dimension d above a floor surface to ensure that the proximal end 524 does not injure a foot of the athlete during adjustment of the post 520, as seen in FIG. 1. This safety feature guarantees that the vertical post 520 does not inadvertently slide through the sleeve 320 to the floor and pinch the athlete's foot in the process. The safety position limiter 526 may be constructed in any number of ways to prevent a portion of the vertical post 520 from entering the sleeve 320. For example, and as illustrated in FIG. 7, the vertical post 520 may be formed with a recess 527, or multiple recesses, that accept a pin 528. The pin 528 extends beyond the walls of the vertical post 520 and blocks the vertical post 520 from entering the sleeve 320 beyond the location of the pin 528. Alternatively, the apparatus 50 may incorporate an adjustable clamp 529 that may be affixed to the vertical post 520 at any desired location to prevent the vertical post 520 from entering the sleeve 320 at the location of the clamp 529, as seen in FIG. 8.

Figure 4:
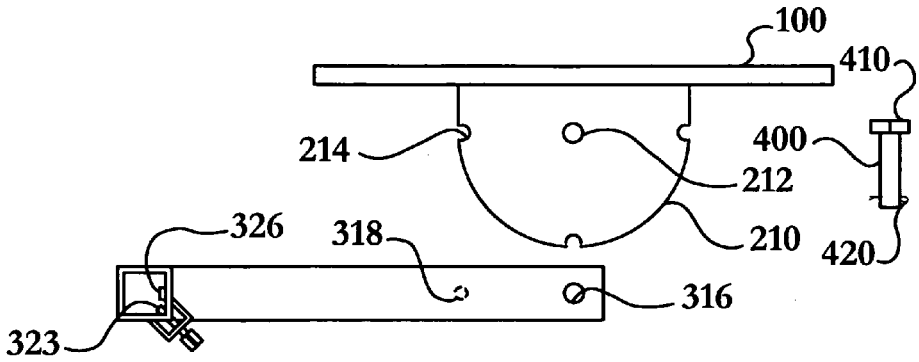
FIG. 4 shows a disassembled top plan view of several of the components of FIG. 3, not to scale.
Figure 9:
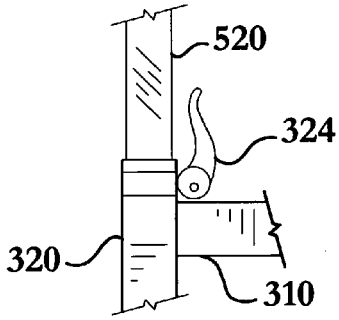
FIG. 9 shows a partial side elevation view of an embodiment of the vertical post, sleeve, and arm, not to scale.

The lock 322, illustrated in FIG. 2, is attached to the sleeve 320 and serves to provide the adjustability of the height of the jump measurement device 500. The lock 322 has an engaged position, wherein the vertical post 520 is secured within the sleeve 320, and a disengaged position, wherein the vertical post 520 is not secured by the lock 322. The lock 322 may include a setscrew 323 that passes through the sleeve 320 and locks the vertical post 520 to the sleeve 320, as seen in FIG. 2 and FIG. 4. The lock 322 is preferably located such that the lock 322 is pointing substantially in the direction of the arm 310 to minimize the likelihood that an athlete's clothing gets snagged on the lock 322. In a further embodiment, the lock 322 may include a quick-release cam 324 system that locks the sleeve 320 and the vertical post 520 in position by compression, as seen in FIG. 9.

Referring again to FIG. 2, the automatic translation resistor 326 is yet another safety improvement designed to minimize the risk of an athlete either getting their finger pinched between the vertical post 520 and the sleeve 320 by a rapidly sliding post 520, or getting their foot injured by the post 520 uncontrollably sliding within sleeve 320. The automatic translation resistor 326 is attached to the sleeve 320 and continuously applies a compressive force on the vertical post 520 to counteract the gravitational force on the jump measurement device 500 and prevent it from accidental translation within the sleeve 320 when the lock 322 is disengaged. The automatic translation resistor 326 requires the athlete to disengage the lock 322 and intentionally apply force to the vertical post 520 in order to adjust the height of the jump measurement device 500. In one embodiment, illustrated in FIG. 6, the translation resistor 326 incorporates a biased cylinder 327 that continuously exerts a compressive force on the vertical post 520. The illustrated embodiment utilizes a spring to bias the cylinder 327 against the vertical post 520. Further, the cylinder 327 may incorporate a textured surface or other non-slip coating to increase the coefficient of friction of the cylinder surface.

The mounting plate 100 is formed with a plurality of fastener openings 110 for receiving fasteners to secure the mounting plate 100 to a wall. The mounting plate 100 may be a plate having a length as long as, or longer, than the sleeve 320, as illustrated in FIG. 1 through FIG. 11, or the plate 100 may be much smaller such that it is essentially at least one bracket to secure the apparatus 50 to the wall. The mounting plate 100 may incorporate features that ease its installation, such as elongated slots 112 for the receipt of the fasteners and permitting a level of adjustability in the fastener location.

The at least one rotational mount 200 is attached to the mounting plate 100 and is designed to releasably and rotationally attach the proximal end 314 of the at least one arm 310 to the mounting plate 100, as seen in FIG. 2. The at least one rotational mount 200 permits the rotating support 300 and the jump measurement device 500 to rotate from the operating position to the storage position where the rotating support 300 and jump measurement device 500 are substantially parallel to the wall. The embodiments illustrated in FIG. 1 through FIG. 11 incorporate a rotational mount 200 for each arm 310. Further, the illustrated embodiments have the at least one rotational mount 200 including a guide plate 210 having a plate guide pin recess 212 that aligns with an arm guide pin recess 316 formed in the at least one arm 310 such that a guide pin 400 is received by the plate guide pin recess 212 and the arm guide pin recess 316, thereby releasably and rotably joining the guide plate 210 and the at least one arm 310, illustrated best in FIG. 2, FIG. 3, and FIG. 4. The guide plate 210 may include at least one auxiliary recess 216, arranged such that a padlock may be secured through the auxiliary recess 216 thereby preventing unauthorized users from rotating the jump measuring device 500 from the storage position to the operating position.

Figure 3:
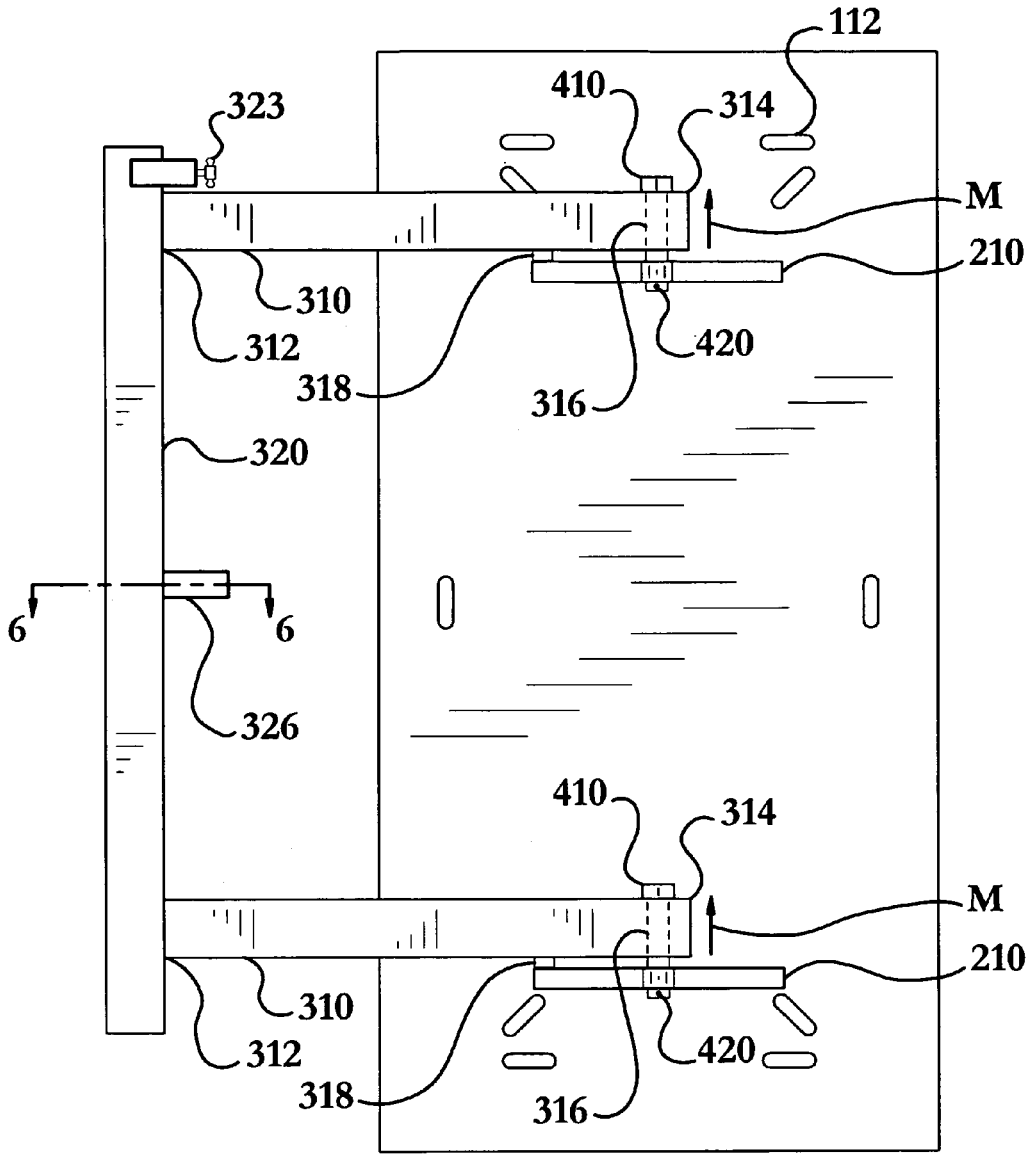
FIG. 3 shows an elevation view of the portion shown in FIG. 2, not to scale.

The guide plate 210 may be formed with a plurality of locking pin recesses 214 to cooperate with a locking pin 318, on the at least one arm 310, sized and located to cooperate with the locking pin recesses 214, illustrated best in FIG. 3 and FIG. 4. One embodiment, illustrated in FIG. 1 through FIG. 3, incorporates a locking pin 318 fixed to the at least one arm 310 and a guide pin 400 configured such that at least one arm 310 may move vertically, indicated by M in FIG. 3, within a predetermined range so that by lifting the arm 310 vertically the locking pin 318 disengages the plurality of locking pin recesses 214, thereby allowing the at least one arm 310 to rotate, indicated by R in FIG. 2, between the storage position and the operating position. Once the arm 310 and locking pin 318 reach the operating position, and the associated locking pin recess 214, the arm 310 and locking pin 318 drop down into the locking pin recess 214, thereby securing the apparatus 50 in the operating position. Then, to remove the apparatus 50 from the operating position, the rotating support 300 must be lifted vertically, indicated by M in FIG. 3, to remove the locking pin 318 from the locking pin recess 214. The guide pin 400, illustrated in FIG. 4, permits the vertical motion of the rotating support 300. In this embodiment the guide pin 400 is longer than necessary to permit the arm 310 to be separated from the guide plate 210. Such a guide pin 400 generally has a head 410 at one end and a cotter pin 420, or other releasable connector or retainer, at the other.

Figure 5:
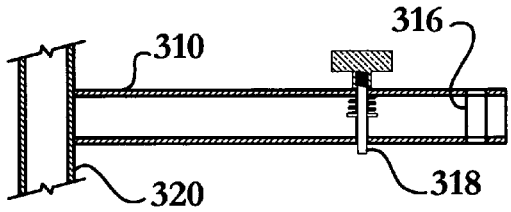
FIG. 5 shows a partial section view of an arm of an embodiment of the present invention, not to scale.
Figure 6:
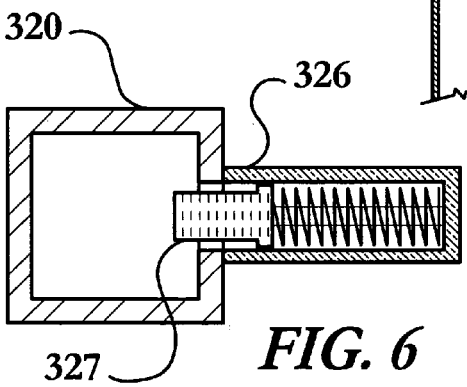
FIG. 6 shows a partial section view, taken along section line 6—6 in FIG. 3, not to scale.

In an alternative embodiment, the locking pin 318 may be a biased locking pin 318 that does not require the user to lift the rotating support 300. One such embodiment is illustrated in FIG. 5 and incorporates a spring-biased locking pin 318. In this embodiment the spring-biased locking pin 318 automatically engages cooperating locking pin recesses 214 when they are encountered. Then, to disengage the locking pin 318, the athlete simply pulls up on the handle of the spring-biased locking pin 318, rather than lifting the rotating support as in the previous embodiment.

Figure 10:
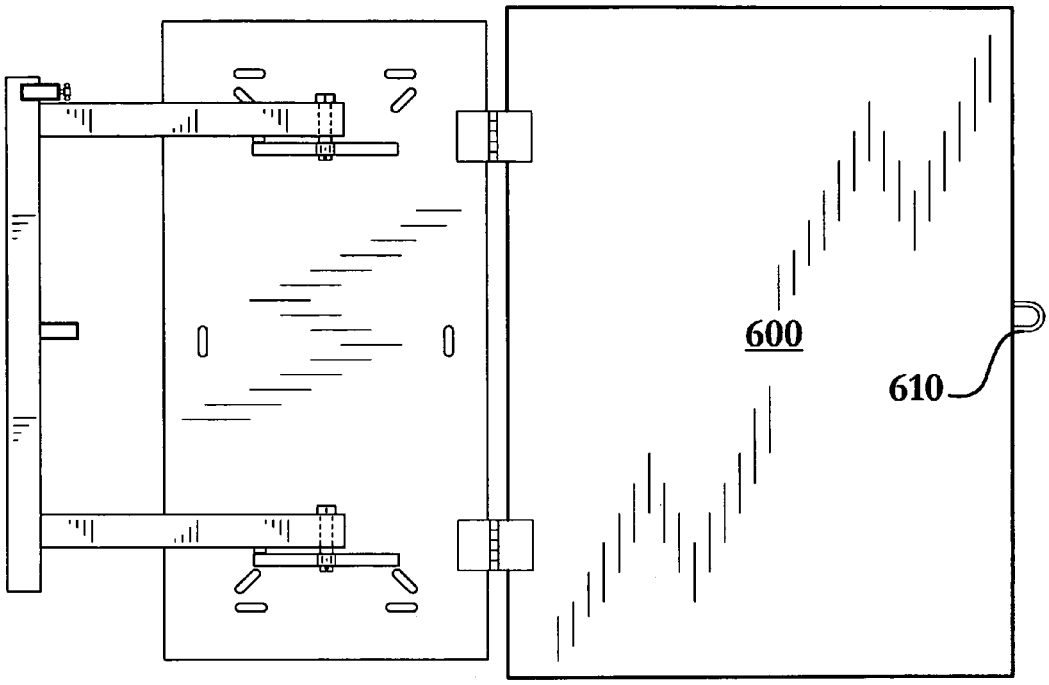
FIG. 10 shows an elevation view of an embodiment of the apparatus having a safety cover in the storage position, not to scale.
Figure 11:
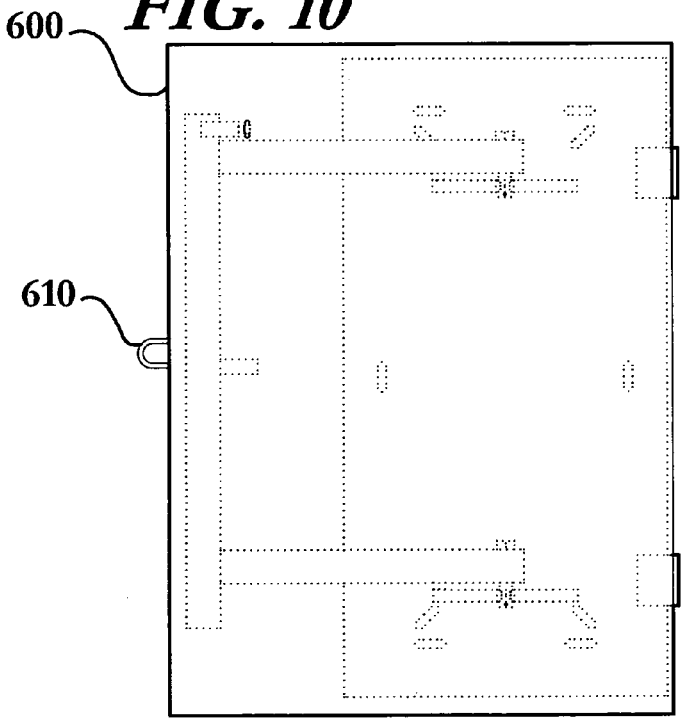
FIG. 11 shows an elevation view of the embodiment of FIG. 10 with the safety cover closed, not to scale.

In yet another embodiment, illustrated in FIG. 10 and FIG. 11, the apparatus 50 includes a safety cover 600 that encloses the rotating support 300, the lock 322, the automatic translation resistor 326, the mounting plate 100, the at least one rotational mount 200, and a portion of the jump measuring device 500 when the apparatus 50 is in the storage position to prevent unintentional contact with such components. The safety cover 600 may be padded to absorb the impact of a colliding athlete. Generally, the safety cover 600 will be hingedly attached to the mounting plate 100 so that the cover 600 may rotate out of the way when the apparatus 50 is in use. Additionally, the safety cover 600 may incorporate a latch 610 that may be used to lock the cover 600 in the closed position and prevent unauthorized users from utilizing the apparatus.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

The corresponding structures, materials, acts, and equivalents of all means or step plus function elements in the claims below are intended to include any structure, material, or acts for performing the functions in combination with other claimed elements as specifically claimed.

We claim:

1. A safety jump training apparatus for wall mounting that permits an athlete to safely measure a vertical leap when the apparatus is in an operating position, the apparatus having a storage position for safely storing the apparatus against a wall when not in use, comprising:

a jump measurement device having a plurality of vanes rotably mounted to a vane mounting post, the mounting post joined to a vertical post having a safety position limiter;

a rotating support having at least one arm, with a distal end and a proximal end, and a vertical sleeve attached to the distal end of the at least one arm and shaped to cooperate with the shape of the vertical post so that the vertical post is slidably received by the sleeve thereby adjusting the height of the jump measuring device, and the motion of the vertical post in the sleeve is limited by the safety position limiter such that a proximal end of the vertical post is limited to a predetermined dimension above a floor surface to ensure that the proximal end does not injure a foot of the athlete during adjustment of the post;

a lock attached to the sleeve having an engaged position, wherein the vertical post is secured within the sleeve, and a disengaged position, wherein the vertical post is not secured by the lock;

an automatic translation resistor attached to the sleeve and configured to continuously apply compressive force on the vertical post to counteract the gravitational force on the jump measurement device and prevent it from accidental translation within the sleeve when the lock is disengaged;

a mounting plate formed with a plurality of fastener openings for receiving fasteners to secure the mounting plate to a wall; and at least one rotational mount attached to the mounting plate and designed to releasably and rotationally attach the proximal end of the at least one arm to the mounting plate so that the rotating support and the jump measurement device may rotate from the operating position to the storage position where the rotating support and jump measurement device are substantially parallel to the wall.

2. The safety jump training apparatus of claim 1, wherein the at least one rotational mount includes a guide plate having a plate guide pin recess that aligns with an arm guide pin recess formed in the at least one arm such that a guide pin is received by the plate guide pin recess and the arm guide pin recess thereby releasably and rotably joining the guide plate and the at least one arm.

3. The safety jump training apparatus of claim 2, wherein the guide plate is formed with a plurality of locking pin recesses and the at least one arm has a locking pin sized and located to cooperate with the locking pin recesses as the at least one arm rotates about the guide pin from the storage position to the operating position.

4. The safety jump training apparatus of claim 3, wherein the locking pin is fixed to the at least one arm and the guide pin is configured such that at least one arm may move vertically within a predetermined range so that by lifting the arm vertically the locking pin disengages the plurality of locking pin recesses thereby allowing the at least one arm to rotate between the storage position and the operating position.

5. The safety jump training apparatus of claim 3, wherein the locking pin is a biased locking pin having a release handle such that the locking pin is biased to automatically enter and engage one of the plurality of locking pin recesses when they align and requires that the release handle be activated to disengage the locking pin to permit rotation of the at least one arm.

6. The safety jump training apparatus of claim 3, further including at least one auxiliary recess formed in the guide plate such that a padlock may be secured through the auxiliary recess thereby preventing unauthorized users from rotating the jump measuring device from the storage position to the operating position.

7. The safety jump training apparatus of claim 1, wherein the translation resistor includes a biased cylinder that continuously exerts a compressive force on the vertical post.

8. The safety jump training apparatus of claim 1, wherein the lock includes a setscrew that passes through the sleeve and locks the vertical post to the sleeve.

9. The safety jump training apparatus of claim 1, wherein the lock includes a quick-release cam system that locks the sleeve and the vertical post in position by compression.

10. The safety jump training apparatus of claim 1, wherein the safety position limiter consists of a recess formed in the vertical post and a pin that cooperates with the recess and prevents the vertical post from translating in the sleeve past the location of the pin.

11. The safety jump training apparatus of claim 1, wherein the safety position limiter includes an adjustable clamp that is secured to the vertical post and prevents the vertical post from translating in the sleeve past the location of the pin.

12. The safety jump training apparatus of claim 1, wherein the at least one arm includes a first arm and a second arm.

13. The safety jump training apparatus of claim 1, further including a vane stop to limit the rotation of the plurality of vanes around the vane mounting post to less than 360 degrees to avoid unintended contact with the back of the athlete's hand or arm.

14. The safety jump training apparatus of claim 1, further including a safety cover that encloses the rotating support, the lock, the automatic translation resistor, the mounting plate, the at least one rotational mount, and a portion of the jump measuring device when the apparatus is in the storage position to prevent unintentional contact with such components.

15. A safety jump training apparatus for wall mounting that permits an athlete to safely measure a vertical leap when the apparatus is in an operating position, the apparatus having a storage position for safely storing the apparatus against a wall when not in use, comprising:

a jump measurement device having a plurality of vanes rotably mounted to a vane mounting post, the mounting post joined to a vertical post having a safety position limiter;

a rotating support having at least one arm, with a distal end and a proximal end, and a vertical sleeve attached to the distal end of the at least one arm and shaped to cooperate with the shape of the vertical post so that the vertical post is slidably received by the sleeve thereby adjusting the height of the jump measuring device, and the motion of the vertical post in the sleeve is limited by the safety position limiter such that a proximal end of the vertical post is limited to a predetermined dimension above a floor surface to ensure that the proximal end does not injure a foot of the athlete during adjustment of the post;

a lock attached to the sleeve having an engaged position, wherein the vertical post is secured within the sleeve, and a disengaged position, wherein the vertical post is not secured by the lock;

an automatic translation resistor, having a biased cylinder, attached to the sleeve and configured to continuously apply compressive force on the vertical post to counteract the gravitational force on the jump measurement device and prevent it from accidental translation within the sleeve when the lock is disengaged;

a mounting plate formed with a plurality of fastener openings for receiving fasteners to secure the mounting plate to a wall; and at least one rotational mount attached to the mounting plate and designed to releasably and rotationally attach the proximal end of the at least one arm to the mounting plate so that the rotating support and the jump measurement device may rotate from the operating position to the storage position where the rotating support and jump measurement device are substantially parallel to the wall, wherein the at least one rotational mount includes a guide plate having a plate guide pin recess that aligns with an arm guide pin recess formed in the at least one arm such that a guide pin is received by the plate guide pin recess and the arm guide pin recess thereby releasably and rotably joining the guide plate and the at least one arm, and wherein the guide plate is formed with a plurality of locking pin recesses and the at least one arm has a locking pin sized and located to cooperate with the locking pin recesses as the at least one arm rotates about the guide pin from the storage position to the operating position.

16. The safety jump training apparatus of claim 15, wherein the locking pin is fixed to the at least one arm and the guide pin is configured such that at least one arm may move vertically within a predetermined range so that by lifting the arm vertically the locking pin disengages the plurality of locking pin recesses thereby allowing the at least one arm to rotate between the storage position and the operating position.

17. The safety jump training apparatus of claim 15, wherein the locking pin is a biased locking pin having a release handle such that the locking pin is biased to automatically enter and engage one of the plurality of locking pin recesses when they align and requires that the release handle be activated to disengage the locking pin to permit rotation of the at least one arm.

18. The safety jump training apparatus of claim 15, further including at least one auxiliary recess formed in the guide plate such that a padlock may be secured through the auxiliary recess thereby preventing unauthorized users from rotating the jump measuring device from the storage position to the operating position.

19. The safety jump training apparatus of claim 15, wherein the safety position limiter consists of a recess formed in the vertical post and a pin that cooperates with the recess and prevents the vertical post from translating in the sleeve past the location of the pin.

20. The safety jump training apparatus of claim 15, wherein the at least one arm includes a first arm and a second arm.

21. The safety jump training apparatus of claim 15, further including a vane stop to limit the rotation of the plurality of vanes around the vane mounting post to less than 360 degrees to avoid unintended contact with the back of the athlete's hand or arm.

22. The safety jump training apparatus of claim 15, further including a safety cover that encloses the rotating support, the lock, the automatic translation resistor, the mounting plate, the at least one rotational mount, and a portion of the jump measuring device when the apparatus is in the storage position to prevent unintentional contact with such components.

23. A safety jump training apparatus for wall mounting that permits an athlete to safely measure a vertical leap when the apparatus is in an operating position, the apparatus having a storage position for safely storing the apparatus against a wall when not in use, comprising:

a jump measurement device having a plurality of vanes rotably mounted to a vane mounting post, the mounting post joined to a vertical post having a safety position limiter;

a rotating support having a first arm and a second arm, each having a distal end and a proximal end, and a vertical sleeve attached to the distal end of each arm and shaped to cooperate with the shape of the vertical post so that the vertical post is slidably received by the sleeve thereby adjusting the height of the jump measuring device, and the motion of the vertical post in the sleeve is limited by the safety position limiter such that a proximal end of the vertical post is limited to a predetermined dimension above a floor surface to ensure that the proximal end does not injure a foot of the athlete during adjustment of the post;

a lock attached to the sleeve having an engaged position, wherein the vertical post is secured within the sleeve, and a disengaged position, wherein the vertical post is not secured by the lock;

an automatic translation resistor, having a biased cylinder, attached to the sleeve and configured to continuously apply compressive force on the vertical post to counteract the gravitational force on the jump measurement device and prevent it from accidental translation within the sleeve when the lock is disengaged;

a mounting plate formed with a plurality of fastener openings for receiving fasteners to secure the mounting plate to a wall;

a first rotational mount and a second rotational mount, each attached to the mounting plate and designed to releasably and rotationally attach the proximal end of each arm to the mounting plate so that the rotating support and the jump measurement device may rotate from the operating position to the storage position where the rotating support and jump measurement device are substantially parallel to the wall, wherein each rotational mount includes a guide plate having a plate guide pin recess that aligns with an arm guide pin recess formed in each arm such that a guide pin is received by the plate guide pin recess and the arm guide pin recess thereby releasably and rotably joining each guide plate and each arm, and wherein each guide plate is formed with a plurality of locking pin recesses and each arm has a locking pin sized and located to cooperate with the locking pin recesses such that the at least one arm may move vertically within a predetermined range so that by lifting each arm vertically the locking pin disengages the plurality of locking pin recesses thereby allowing the arms to rotate between the storage position and the operating position;

at least one auxiliary recess formed in the guide plate such that a padlock may be secured through the auxiliary recess thereby preventing unauthorized users from rotating the jump measuring device from the storage position to the operating position; and a safety cover that encloses the rotating support, the lock, the automatic translation resistor, the mounting plate, the at least one rotational mount, and a portion of the jump measuring device when the apparatus is in the storage position to prevent unintentional contact with such components.

* * * * *